US005188523A

United States Patent [19]

Zatrieb et al.

[11] Patent Number: 5,188,523

[45] Date of Patent: Feb. 23, 1993

[54] INTERNAL GEAR MACHINE HAVING A FILLER PIECE WITH PIVOT PINS AND A SEPARATING GAP

[75] Inventors: Jacek Zatrieb, Eggingen; Clemens Dörflinger, Birkendorf, both of Fed. Rep. of Germany

[73] Assignee: Bucher GmbH, Maschinenfabrik, Klettgau, Fed. Rep. of Germany

[21] Appl. No.: 768,229

[22] PCT Filed: Feb. 19, 1991

[86] PCT No.: PCT/EP91/00312

§ 371 Date: Oct. 18, 1991

§ 102(e) Date: Oct. 18, 1991

[87] PCT Pub. No.: WO91/12430

PCT Pub. Date: Aug. 22, 1991

[30] Foreign Application Priority Data

Feb. 19, 1990 [CH] Switzerland ..... CH522/90

[51] Int. Cl.[5] ..... F01C 21/02

[52] U.S. Cl. ..... 418/126; 418/169; 418/170

[58] Field of Search ..... 418/126, 125, 169, 170

[56] References Cited

U.S. PATENT DOCUMENTS

| | | | |
|---|---|---|---|
| 3,890,066 | 6/1975 | Eckerle | 418/126 |
| 4,778,363 | 10/1988 | Buchmüller | 418/126 |

FOREIGN PATENT DOCUMENTS

| | | | |
|---|---|---|---|
| 551485 | 6/1932 | Fed. Rep. of Germany . | |
| 1280056 | 10/1968 | Fed. Rep. of Germany . | |
| 1905146 | 10/1970 | Fed. Rep. of Germany . | |
| 2641278 | 3/1978 | Fed. Rep. of Germany | 418/126 |
| 2942417 | 1/1988 | Fed. Rep. of Germany . | |
| 603770 | 4/1978 | U.S.S.R. | 418/126 |

*Primary Examiner*—Richard A. Bertsch
*Assistant Examiner*—Charles G. Freay
*Attorney, Agent, or Firm*—Edmund M. Jaskiewicz

[57] ABSTRACT

Filler piece (8) of a gear pump or a gearmotor, mounted in an interspace (4), formed from an internal gear (2) and a pinion (3), exhibits a sickle-shaped seal (7), with which laterally projecting pivot pins (6) are connected, and filler piece (8) is designed in one-piece and/or in two parts by a separating gap (14) extending from high-pressure area (13) into low-pressure space (11).

20 Claims, 2 Drawing Sheets

INTERNAL GEAR MACHINE HAVING A FILLER PIECE WITH PIVOT PINS AND A SEPARATING GAP

Figure 1:
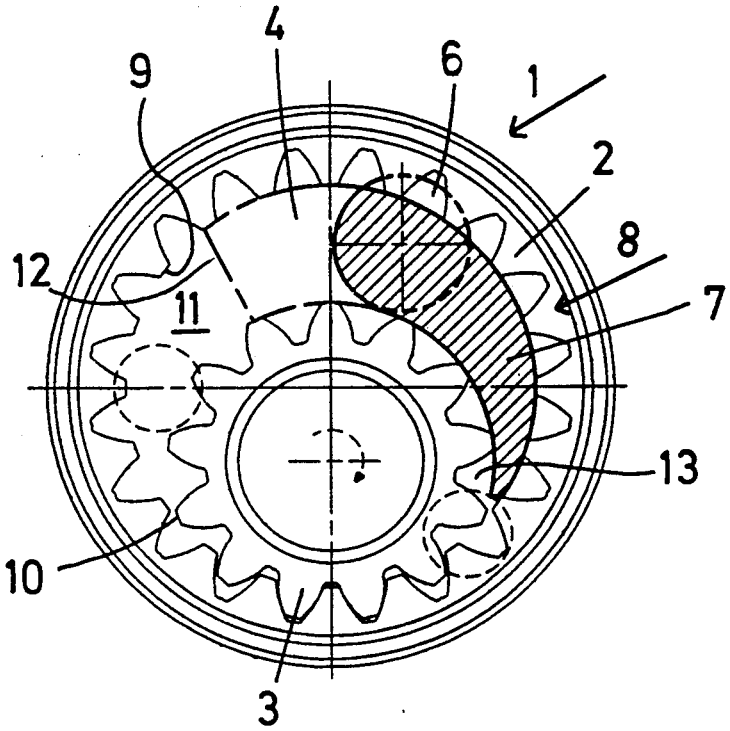

The invention relates to a gear pump or gearmotor with a filler member positioned in a sickle-shaped chamber formed from a pinion gear meshing within an internal gear and the filler piece resting at least partially on the crests of the gear teeth of the pinion and/or internal gear and comprising a substantially sickle-shaped seal having a pivot pin projecting from one side thereof.

To achieve a favorable volumetric efficiency, in the present object the leakage flows of the medium to be conveyed between the high-pressure and low-pressure space are to be kept as small as possible In this case, for sealing between the high-pressure and low-pressure space, great demands are made, i.a., on the sealing element — also called filler piece — which, on the one hand, has to be able to offset in a sealed manner the gap occurring on at least one of the sides facing the teeth and to assume the stresses of the acting forces. In addition, the sealing element is to be marked by advantageous sliding properties on the adjacent parts.

By DE-PS 15 53 027 an internal gear pump has become known, in which the sealing element is movably mounted on both sides by a penetrating bolt in a slide ring each placed in axial plates. In the design it is essential that the resultant of the hydraulic forces acting on the filler piece run through the geometric axis of the filler piece bolt.

Because of DE-PS 29 42 417 an internal gear machine is known, which exhibits a half-sickle-shaped filler piece divided along a partial surface extending approximately in the peripheral direction, whose filler piece parts are supported with support surfaces on a filler piece pin, mounted to rotate around its longitudinal axis, axially going through the space between internal gear and pinion. For this purpose, a plane support surface is provided on the filler piece pin and the filler piece comprises several parts whose assembly requires corresponding care an special attention.

To avoid the filler piece being wedged by friction with the teeth between pinion and internal gear in a pressureless start, especially of an internal gear machine, according to DE-OS 16 53 818, i.a., an additional pin going through the filler piece in the axial direction is used.

These embodiments comprise the common disadvantage according to which by the sealing and holding functions, distributed to many parts, the number of separating lines and friction surfaces increases and thus leads to great stresses.

Thus, the object of the invention is to configure the filler piece of a gear pump or gearmotor of the initially described type so that the sealing between high-pressure and low-pressure space is considerably improved and the assembly of the filler piece is facilitated as well as the operating reliability and less wear—for example, by reduction of the support surfaces—can be established.

According to the invention this object is achieved in that seal and pivot pins are constructed in one piece at least as part of the filler piece.

As a result, the wear resistance and the operating reliability are improved.

A preferred embodiment of the filler piece comprises a one-piece filler piece formed from seal and pivot pins.

The incorporation of the filler piece in the laterally adjacent parts of the gear pump or gearmotor can take place in the simplest way.

Placing of the pivot pins on the end of the seal facing the low-pressure space allows an optimal use of the sealing surfaces on the teeth tips by the outsides of the seal being drawn over the entire length of extension of the filler piece in the interspace.

To improve the adaptability of the seal on the teeth tips, the filler piece can be provided with a separating gap, forming an inside and outside leg, extending from the high-pressure area in the peripheral direction. As a result, especially by the increased elasticity of the separated seal a clearly improved sealing action can be produced on the teeth tips.

Since seal and pivot pins together form a filler piece, it is possible, i.a., that the separating gap can be extended at least approximately on the entire extension length of the filler piece. This means that the inside and outside legs on the end of the filler piece facing the low-pressure space are connected to one another.

With such a structure it is suitable if the separating gap on the end facing the low-pressure space has a hollow space thus as a result of the separating gap largely to avoid the notch effect occurring in the seal and to increase the elasticity of the inside and outside legs.

In this connection, a form of the hollow space increasing approximately constantly toward the low-pressure space proves to be excellent.

Alternatively, for the same purpose the hollow space can have evenly spaced separating walls running approximately in the peripheral direction to be able to provide the hollow space as a core already in the production of the filler piece blank by casting.

Corresponding to the occurring circumstances or requirements the hollow space could be tapered toward the low-pressure space, and thus have an advantageous effect on the resistance, wear and elasticity of the filler piece.

To achieve optimal resistance values it is advantageous if the separating gap at least in the area of the pivot pin is placed approximately centrally in the seal. This also applies if the separating gap ends before the pivot pin.

To be able to simplify the production of the separating gap and significantly increase the elasticity of the filler piece, it extends relative to its width over the entire width of the filler piece.

As material preferably a copper alloy such as, for example, brass or bronze, is recommended, which has good sliding and dry-running properties. Of course, another material, equipped with these properties and a favorable elasticity behavior can also be used. Also bimetals or coated materials can be used.

By the design measure that the hollow space extends in the seal beyond the periphery of the pivot pins facing the high-pressure area, the production of the separating gap before the hollow space can be simplified, for example, by wire erosion. Further, by the proposed configuration and type of production of the separating gap, production costs are saved.

Instead of a separating gap, with the corresponding elasticity of the material, used the seal could include a hollow space extending over a great portion of the filler piece, which, for example, is connected to the high-pressure area by one or more bores or lateral grooves.

This hollow space would advantageously adjust to the outside shape of the seal in the sense of a favorable adaptability of the inside and outside leg, i.e., the walls of the hollow space run approximately parallel to the outsides of the inside and outside leg. In case of a prefabricated casting blank the hollow space could be designed as a core of a mold.

As another alternative embodiment of the idea of the invention the filler piece, formed from seal and pivot pins, could be separated into separate parts by the separating gap, and the sealed separation of the low-pressure and high-pressure space can take place by a shaft placed on the width of the separating gap.

Preferably, for this purpose, the inside and outside leg are provided with bearing bushings. The shaft itself can be anchored or mounted torsion-resistant or rotatable in these bearing bushings. The latter embodiment allows swinging movements of the inside and outside legs in the pivot bearing formed by shaft and bearing bushings, which at the same time separates the high-pressure area from the low-pressure space. Placing the pivot bearing on the length of the separating gap is to be determined in coordination between volumetric efficiency of the gear pump or gearmotor and the wear by friction between the teeth and the seal. In comparison with one-piece filler piece, in the embodiment according to FIG. 7 the sealing between high-pressure area and low-pressure space takes place by shaft and bearing bushings on inside leg 15 and outside leg 16.

Of course, as already indicated, the shaft could be placed on the length of the separating gap offset to the axis of the pivot pins and thus be used purely for sealing the separating gap.

With all the above-described embodiments the pivot pin or pins can be placed at distance from the end of the seal facing the low-pressure space.

In this case it is suitable if the seal, in the area of the pivot pin/pins is designed at least on one of the sides facing the teeth tips with a set-back section so that swinging movements of the inside and outside leg lead to favorable sealing conditions.

It is equally suitable—if the pivot pins exhibit a larger diameter than the height of the seal—that at least one outside of the seal becomes approximately flush on the pivot pin periphery.

To be able to keep the hydraulic forces acting on the seal on the filler piece equalized, it is advantageous if the pivot pin/pins is/are placed in the line of application of the resultants on the seal resulting from the hydraulic forces acting on the seal; also with a shortened separating gap, which ends before the pivot pin/pins.

The shape on the end of the seal facing the low-pressure space is advantageously adapted to the peripheral shape of the pivot pins.

An improvement of the efficiency of the filler piece can thus be achieved if at least one of the inside and outside legs is designed prestressed resting on the teeth of internal gear and/or pinion.

Inside the housing of the gear machine the filler piece can be fastened rigid or mobile for its efficiency.

Figure 3:
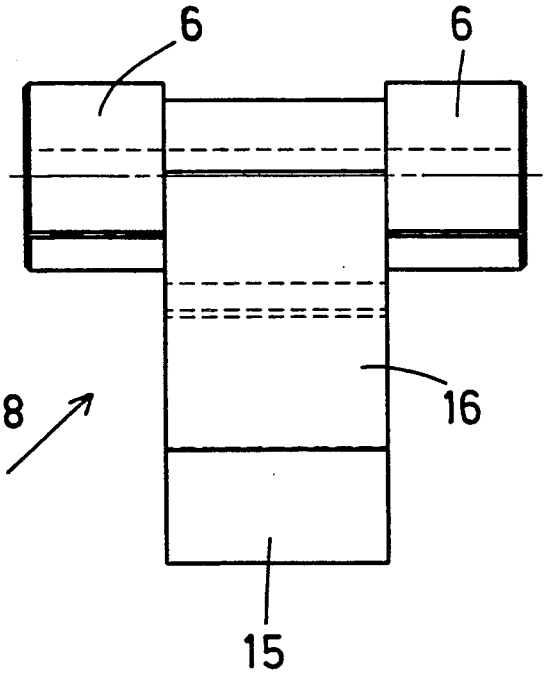
Figure 2:
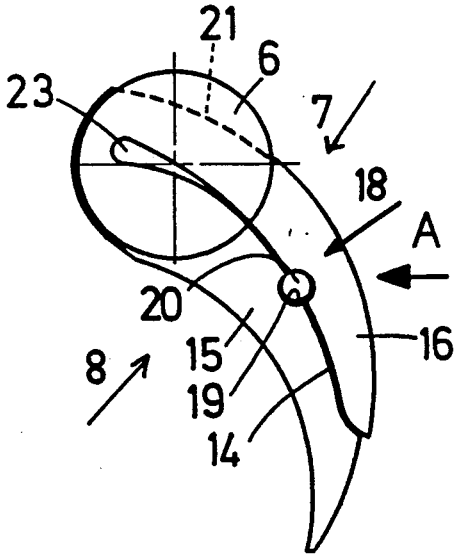
Figure 4:
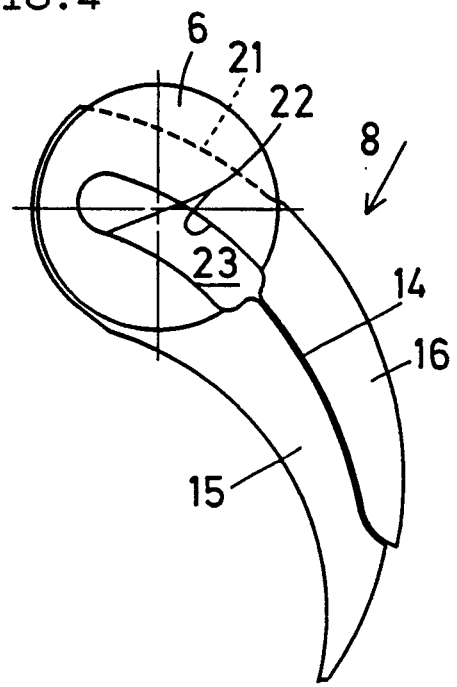
Figure 5:
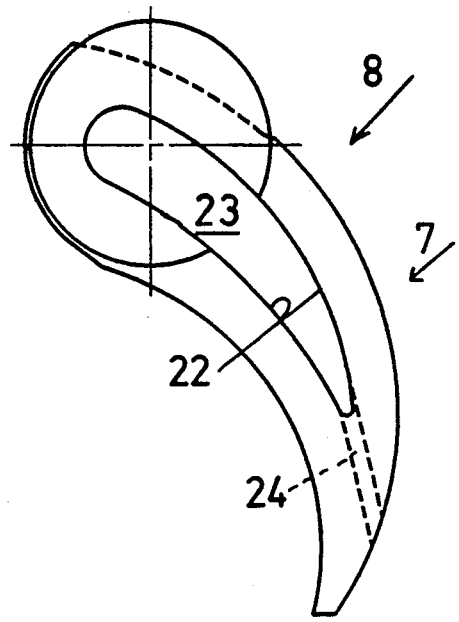
Figure 6:
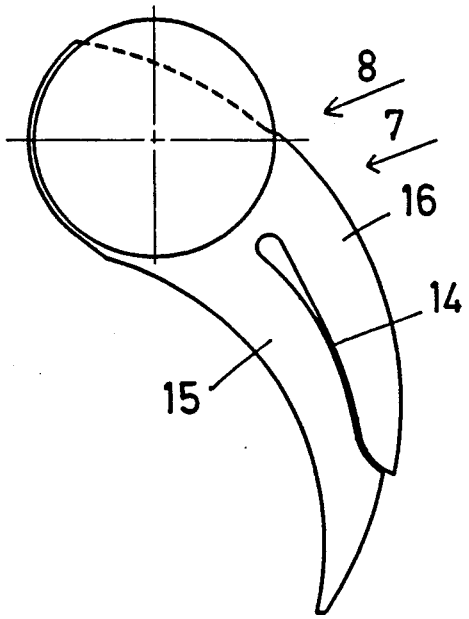
Figure 7:
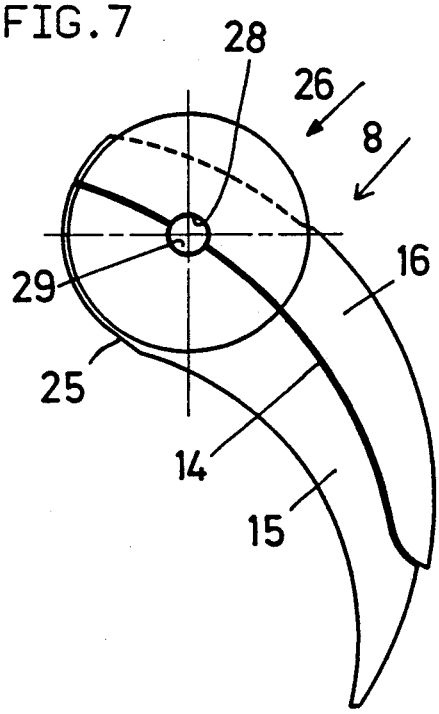

Embodiments of the invention are explained in the following description with the drawing. There are shown in:

FIG. 1, a cross section through an internal gear machine perpendicular to its axis of rotation, FIG. 2, a side view of a filler piece, FIG. 3, a view of the filler piece according to arrow A in FIG. 2, FIG. 4, an alternative embodiment of a filler piece, FIG. 5, another alternative embodiment of a filler piece, FIG. 6, another alternative embodiment of a filler piece, and FIG. 7, filler piece designed in two parts.

FIG. 1 shows an internal gear pump 1 with an internally geared internal gear 2 rotatably mounted within a housing and with a pinion 3, meshing with it, between which a filler piece 8, formed from a seal 7 and at least one pivot pin 6, is placed or mounted in an interspace 4. Filler piece 8 and teeth 9, 10 of internal gear 2 and of pinion 3 limit low-pressure space 11, into which, on the one hand, the feed medium flows, and on the other hand, a high-pressure area 13 is located between these teeth 9, 10 on the back end of seal 7 in the flow direction.

The possibility of placing pivot pin/pins 6 on the extension line of seal 7 in interspace 4 is to be illustrated by a dash-and-dot line 12. Offset pivot pin 6 is also recognizable outside a possible center line of seal 7.

FIG. 2 and 3 show another alternative embodiment of filler piece 8, which just as in FIG. 1, is constructed as a one-piece unit, with the difference that in seal 7 it extends from its back end located in high-pressure area 13 from a separating ga 14 having separating surfaces approximately parallel to the axes of internal gear 2 and pinion 3 to pivot pin 6 and ends in it, and in this case pivot pins 6 are placed on the end of seal 7 facing low-pressure space 11. Separating gap 14 divides seal 7 into an inside leg 15 and outside leg 16, which are permanently connected to the end facing low-pressure space 11. On the end separating gap 14 is formed by two aligned pivot pins 6 becoming larger by a constantly increasing or droplike hollow space 23, which is to reduce the notch effect considerably. In separating gap 14 is a sealing device 18, consisting a half-shell 19 each allocated to each leg 15, 16, shells which together receive a sealing roll 20, which by the pressure from high-pressure area 13 seals the opening of extending separating gap 14 relative to high-pressure space 13. This sealing device 18, in coordination with spreading caused by the pressure in separating gap 14 on legs 15, 16 at a corresponding place in separating gap 14, which runs approximately through the axis of cylindrically formed pivot pins 6 and is distributed approximately in the center on the sickle-shaped shape of seal 7. The width of seal 7 is adapted to those widths of internal gear 2 and pinion 3 so that seal 7 remains mobile. In the area of pivot pins 6 seal 7 exhibits on outside leg 16 or on its outside facing teeth 9 of internal gear 2 a set-back section 21. Separating gap 14, as also hollow space 23 provided on its end, are placed approximately in the center in the peripheral direction in seal 7 and extend over the entire length of pivot pins 6.

An alternative embodiment is shown in FIG. 4, according to which separating gap 14 is formed with a hollow space 23 exhibiting approximately aligned, extending, further spaced separating walls 22. This hollow space 23 improves the elasticity and adaptability of legs 15, 16 on the teeth tips of teeth 9, 10 of internal gear 2 and pinion 3 and can be recessed by a core during casting of the filler piece blank. Separating walls 22, which according to FIG. 4 run approximately parallel and are connected at the end by a regular circular bend, could also be placed to form another geometric shape. Since separating gap 14 can be produced by wire erosion, but attachments for such a processing are in the way, hollow space 23 extends over pivot pins 6 in seal 7. Also this embodiment, as can be seen in FIG. 2, could comprise a sealing device 18 and set-back section 21 could also be provided on the opposite side of seal 7 or on both sides.

Instead of a separating gap 14, filler piece 8 or seal 7 in FIG. 5 has a sickle-shaped hollow space 23, which is connected to high-pressure area 13 by a bore 24. This embodiment is especially suitable when an elastic material is used. Separating walls 22 are preferably applied parallel to the outsides of seal 7 or aligned with the bend of separating gap 14 and are connected by bends at both ends.

FIG. 6 shows a filler piece 8, in which separating gap 14 in broadened form, as for example in FIG. 2, but ends before pivot pins 6 in seal 7.

In FIG. 7 a two-part filler piece 8 is represented, and separating gap 14, from high-pressure area 13 to low-pressure space 11, running approximately uniformly distributed on the sickle-shaped cross sectional shape, forms two separate parts, on the one hand, from inside leg 15 and pivot pin part 25 and, on the other hand, from outside leg 16 and pivot pin part 26. In the center of pivot pins 6, formed from two parts 25, 26, shaft 29 is located in bearing bushings 27, 28, which, with filler piece 8 assembled, keep the pressure-loaded space of the separating gap tight relative to low-pressure space 11. Of course, instead of shaft 29, also a sealing device 18—as shown in FIG. 2—could be installed before the axis of pivot pins 6 in separating gap 14 or in addition to shaft 29 a sealing device 18 could be installed in separating gap 14.

The design of filler pieces 8 according to FIGS. 1 to 7 allows the special arrangement between seal 7 and pivot pins 6 so that the line of application of the resulting hydraulic force acting on seal 7 intersects the axis of pivot pins 6.

We claim:

1. An internal gear machine comprising a ring gear having internal teeth, a pinion gear disposed within said ring gear to define a sickle-shaped chamber therebetween having a low pressure suction end and a high pressure discharge end and having external teeth meshing with said internal teeth of said ring gear, a substantially sickle-shaped sealing member disposed in said chamber, said sealing member comprising a one-piece sickle-shaped filler member and at least pivot pin projecting axially from a side thereof at an end of said sealing member directed toward the low pressure end of said chamber, said filler member having a substantially circumferentially disposed gap therein extending from a portion of the filler member directed towards said high pressure end of the chamber to define an inner leg and an outer leg, said inner and outer legs contacting at least partially the crests of the gear teeth of said pinion and ring gears respectively, said gap extending substantially to an end of said filler member directed toward said low pressure end at least into that portion of the filler member within an axial projection of the periphery of said pivot pin.

2. An internal gear machine as claimed in claim 1 wherein said inner and outer legs are connected at the end of the filler member directed toward said low pressure end of said chamber.

3. An internal gear machine as claimed in claim 1 wherein said gap widens at the end directed toward said low pressure end of the chamber to define a hollow space within said filler member.

4. An internal gear machine as claimed in claim 3 wherein said hollow space widens gradually toward said low pressure end of said chamber.

5. An internal gear machine as claimed in claim 3 wherein said hollow space has an equal width extending substantially circumferentially.

6. An internal gear machine as claimed in claim 3 wherein said hollow space widens progressively toward said low pressure end of the chamber to define a tapered profile.

7. An internal gear machine as claimed in claim 1 wherein said gap at least in the area of said pivot pin is disposed substantially in the center of the filler member.

8. An internal gear machine as claimed in claim 1 wherein said gap extends along the entire length of the filler member.

9. An internal gear machine as claimed in claim 3 wherein said hollow space extends beyond the periphery of the pivot pin toward the high pressure end of said chamber.

10. An internal gear machine as claimed in claim 1 wherein said hollow space is so positioned as to be acted upon by the pressure medium within the internal gear machine.

11. An internal gear machine as claimed in claim 3 wherein said hollow space has its walls positioned substantially parallel to the respective outer surfaces of said sealing member contacting the crests of the gear teeth of said pinion and ring gears.

12. An internal gear machine as claimed in claim 1 wherein said gap extends from the end of said filler member directed toward said high pressure end of the chamber to the end of said filler member directed toward the low pressure end of the chamber to define said inner and outer legs, and a shaft extending axially through said gap between said inner and outer legs.

13. An internal gear machine as claimed in claim 12. and further comprising bearing bushings in said inner and outer legs sealingly enclosing said shaft.

14. An internal gear machine as claimed in claim 12 wherein said shaft is concentric to said pivot pin.

15. An internal gear machine as claimed in claim 1 wherein said sealing member has a recessed portion at least on its surface directed toward said ring gear in the area of said pivot pin.

16. An internal gear machine as claimed in claim 1 wherein at least one of the surfaces of said filler member contacting the teeth of said pinion and ring gears is flush with the peripheral surface of said pivot pin.

17. An internal gear machine as claimed in claim 1 wherein hydraulic forces acting on said sealing member during operation of the internal gear machine produce a resultant force, said pivot pin being disposed in the line of application of said resultant force.

18. An internal gear machine as claimed in claim 1 wherein the end of said sealing member directed toward the low pressure and of said chamber conforms to the shape of the pivot pin.

19. An internal gear machine as claimed in claim 1 wherein at least one of the said inner and outer legs contacts the respective gear teeth in a pre-stressed condition.

20. An internal gear machine as claimed in claim 1 wherein said internal gear machine comprises a housing, said filler member being disposed one of rigidly or movably in said housing.

* * * * *